US009057223B2

(12) United States Patent
Perrin et al.

(10) Patent No.: US 9,057,223 B2
(45) Date of Patent: Jun. 16, 2015

(54) DIRECTIONAL DRILLING SYSTEM

(75) Inventors: Cedric Perrin, Forcelles Saint Gorgon (FR); Geoffrey C. Downton, Gloucestershire (GB); Christopher C. Bogath, Gloucestershire (GB); Bertrand Lacour, Cambridge (GB); Paul Crerar, Cheltenham (GB)

(73) Assignee: Schlumberger Technology Corporation, Sugar Land, TX (US)

( * ) Notice: Subject to any disclaimer, the term of this patent is extended or adjusted under 35 U.S.C. 154(b) by 338 days.

(21) Appl. No.: 13/529,997

(22) Filed: Jun. 21, 2012

(65) Prior Publication Data

US 2013/0341098 A1 Dec. 26, 2013

(51) Int. Cl.
*E21B 7/04* (2006.01)

(52) U.S. Cl.
CPC ..... *E21B 7/04* (2013.01)

(58) Field of Classification Search
CPC ..... E21B 7/04; E21B 7/062
USPC ..... 175/61, 73, 74
See application file for complete search history.

(56) References Cited

U.S. PATENT DOCUMENTS

| | | | | |
|---|---|---|---|---|
| 3,667,556 | A * | 6/1972 | Henderson | 175/73 |
| 5,113,953 | A | 5/1992 | Noble | |
| 5,265,682 | A | 11/1993 | Russell et al. | |
| 5,520,255 | A | 5/1996 | Barr et al. | |
| 5,553,678 | A | 9/1996 | Barr et al. | |
| 5,553,679 | A | 9/1996 | Thorp | |
| 5,582,259 | A | 12/1996 | Barr | |
| 5,603,385 | A | 2/1997 | Colebrook | |
| 5,673,763 | A | 10/1997 | Thorp | |
| 5,685,379 | A | 11/1997 | Barr et al. | |
| 5,695,015 | A | 12/1997 | Barr et al. | |
| 5,706,905 | A | 1/1998 | Barr | |
| 5,778,992 | A | 7/1998 | Fuller | |
| 5,803,185 | A | 9/1998 | Barr et al. | |
| 5,971,085 | A | 10/1999 | Colebrook | |
| 6,059,661 | A | 5/2000 | Simpson | |
| 6,089,332 | A | 7/2000 | Barr et al. | |
| 6,092,610 | A | 7/2000 | Kosmale et al. | |
| 6,158,529 | A | 12/2000 | Dorel | |
| 6,216,802 | B1 | 4/2001 | Sawyer | |
| 6,244,361 | B1 | 6/2001 | Comeau et al. | |
| 6,290,003 | B1 * | 9/2001 | Russell | 175/73 |
| 6,364,034 | B1 | 4/2002 | Schoeffler | |
| 6,394,193 | B1 | 5/2002 | Askew | |
| 7,188,685 | B2 | 3/2007 | Downton et al. | |

(Continued)

OTHER PUBLICATIONS

International Search Report and Written Opinion for the equivalent PCT patent application No. PCT/ US2013/041787 issued on Jul. 26, 2013.

*Primary Examiner* — Robert E Fuller
(74) *Attorney, Agent, or Firm* — Chadwick A. Sullivan; Wesley Noah

(57) ABSTRACT

A technique facilitates drilling of wellbores or other types of bore holes in a variety of applications. A steerable system or other well tool is designed with a plurality of actuators which are positioned to provide controlled steering during a drilling operation. Each actuator includes at least one loose element or ball slidably mounted in a corresponding sleeve. Pressurized fluid is used to provide controlled movement of the elements along the corresponding sleeves of the actuators. The controlled movement of the elements assists in the provision of steering or other control over the well tool during the drilling operation.

22 Claims, 7 Drawing Sheets

(56) References Cited

U.S. PATENT DOCUMENTS

| | | | | |
|---|---|---|---|---|
| 7,287,605 | B2 * | 10/2007 | Van Steenwyk et al. | 175/61 |
| 8,157,024 | B2 | 4/2012 | de Paula Neves et al. | |
| 8,191,652 | B2 * | 6/2012 | Kotsonis et al. | 175/61 |
| 8,360,174 | B2 * | 1/2013 | Hall et al. | 175/385 |
| 2001/0052428 | A1 | 12/2001 | Larronde et al. | |
| 2002/0011359 | A1 | 1/2002 | Webb et al. | |
| 2003/0127252 | A1 | 7/2003 | Downton et al. | |
| 2010/0025115 | A1 | 2/2010 | Kotsonis et al. | |
| 2011/0042144 | A1 | 2/2011 | Downton | |
| 2014/0209389 | A1 * | 7/2014 | Sugiura et al. | 175/73 |

* cited by examiner

DIRECTIONAL DRILLING SYSTEM

BACKGROUND

Hydrocarbon fluids such as oil and natural gas are obtained from a subterranean geologic formation, referred to as a reservoir, by drilling a well that penetrates the hydrocarbon-bearing formation. Controlled steering or directional drilling techniques are used in the oil, water, and gas industry to reach resources that are not located directly below a wellhead. A variety of steerable systems have been employed to provide control over the direction of drilling when preparing a wellbore or a series of wellbores having doglegs or other types of deviated wellbore sections.

SUMMARY

In general, the present disclosure provides a system and method for drilling of wellbores or other types of bore holes in a variety of applications. A steerable system or other well tool is designed with a plurality of actuators which are positioned to provide controlled steering during a drilling operation, e.g. a wellbore drilling operation. Each actuator comprises at least one ball slidably mounted in a corresponding ball sleeve. Pressurized fluid is used to provide controlled movement of the balls along the corresponding ball sleeves of the actuators. The controlled movement of the balls enables steering control and/or other control over the well tool during the drilling operation. As used herein, the term "ball" does not necessarily mean a spherical element. A ball may be a substantially spherical loose element, but it may also be of any acceptable shape, including, but not limited to, substantially ovoid or substantially cylindrical. Similarly, a ball sleeve is not necessarily cylindrically shaped, but may be of any shape necessary to accept the loose element, such as, but not limited to, a cylinder having an oval or other non-circular cross-section.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

Figure 1:
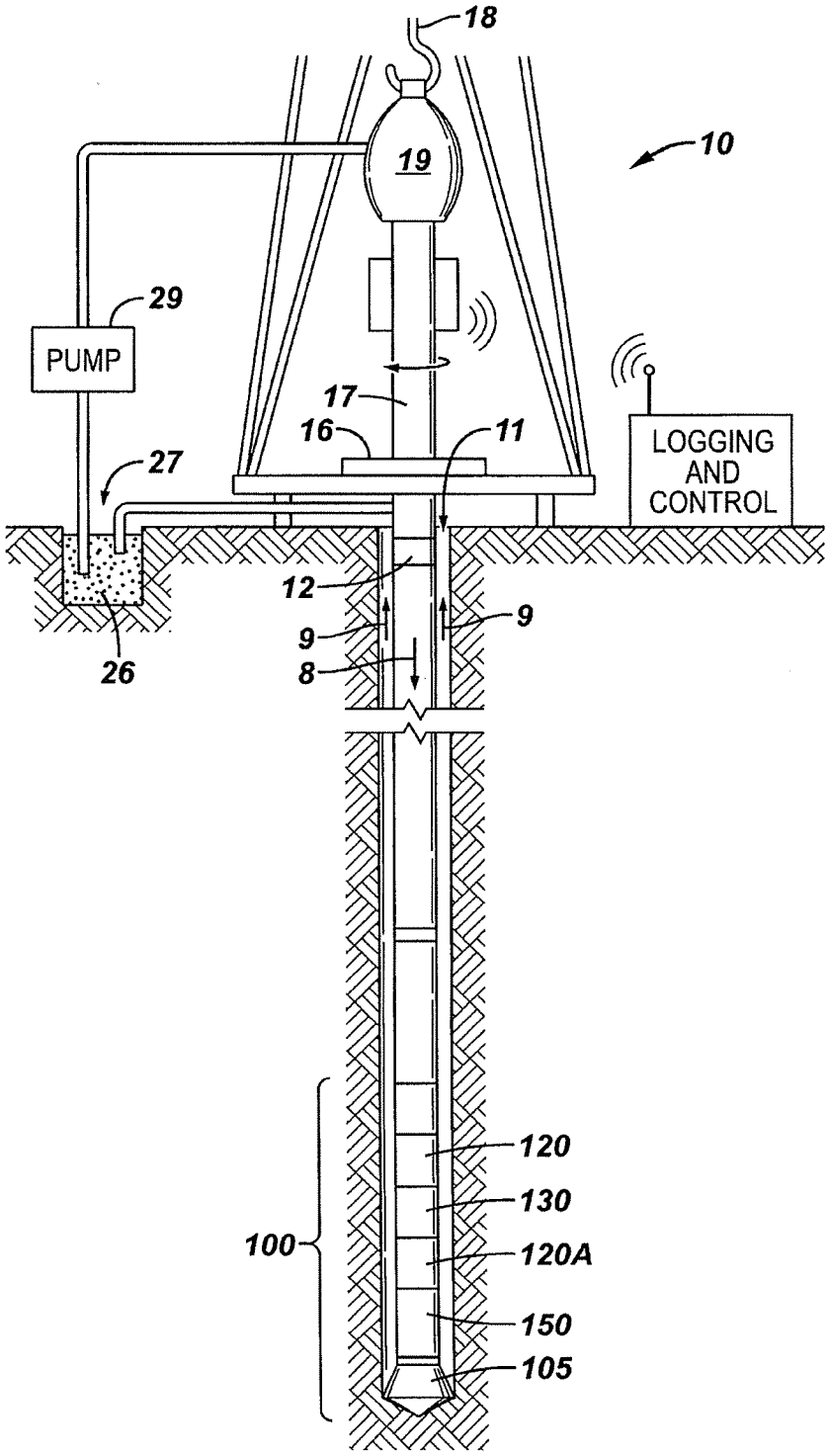
FIG. 1 is a wellsite system in which embodiments of a steerable system can be employed, according to an embodiment of the disclosure.

In the following description, numerous details are set forth to provide an understanding of some illustrative embodiments of the present disclosure. However, it will be understood by those of ordinary skill in the art that the system and/or methodology may be practiced without these details and that numerous variations or modifications from the described embodiments may be possible.

The disclosure herein generally involves a system and methodology related to steerable systems which may be used to enable directional drilling of bore holes, such as wellbores. The system and methodology provide a steerable system which utilizes actuators to create the steering forces used to orient the steerable system in a desired drilling direction. By way of example, the steerable system may comprise a main shaft coupled to an output shaft, e.g., a drill bit shaft, by a universal joint; and actuators (for example, ball actuators) may be positioned to pivot the output shaft with respect to the main shaft about the universal joint. The actuators may comprise balls located in corresponding sleeves, and drilling mud or other actuating fluid may be used to move the balls along their corresponding sleeves in a manner which provides the desired steering by pivoting the output shaft with respect to the main shaft.

In some drilling applications, the steerable system may comprise a rotary steerable system, such as a hybrid rotary steerable system employing both push-the-bit and point-the-bit approaches. The rotary steerable system may provide high dog leg capability while reducing susceptibility to wear, and other parameters, such as abrasion, temperature and pressure. The rotary steerable system also is compatible with many types of drilling mud employed in wellbore drilling applications. In these types of wellbores drilling applications, pumps are used to provide drilling fluid, e.g., drilling mud, downhole under pressure. The drilling fluid has a high differential pressure as it flows into the rotary steerable system and a portion of the drilling fluid is selectively directed to the ball actuators to move the balls along corresponding ball sleeves. As rotational motion is imparted to the rotary steerable system, the actuators are sequentially moved in a manner which maintains the output shaft at a desired angle with respect to the main shaft. The drilling fluid may be exhausted around the outside of the balls and into the surrounding borehole. Additionally, the actuators may be located at spaced, circumferential positions around the rotary steerable system, and in some applications four ball actuators are spaced at approximately 90° from each other in a circumferential direction around the rotary steerable system. Depending on the application, each ball actuator may comprise, for example, a single ball or a plurality of balls slidably mounted in a plurality of corresponding ball sleeves.

The steerable system described herein may be used in a variety of drilling applications in both well and non-well environments and applications. For example, the rotary steerable system can facilitate drilling of bore holes through subterranean formation materials and through a variety of other earth materials to create many types of passages. In well related applications, the steerable drilling system can be used to facilitate directional drilling for forming a variety of deviated wellbores. An example of a well system incorporating the steerable drilling system is illustrated in FIG. 1.

Referring to FIG. 1, a wellsite system is illustrated in which embodiments of the steerable system described herein can be employed. The wellsite can be onshore or offshore. In this system, a borehole 11 is formed in subsurface formations by rotary drilling. However, embodiments of the steerable system can be used in many types of directional drilling applications.

In the example illustrated, a drill string 12 is suspended within the borehole 11 and has a bottom hole assembly (BHA) 100 which includes a drill bit 105 at its lower end. The surface system includes platform and derrick assembly 10 positioned over the borehole 11, the assembly 10 including a rotary table 16, kelly 17, hook 18 and rotary swivel 19. The drill string 12 is rotated by the rotary table 16, energized by means not shown, which engages the kelly 17 at the upper end of the drill string. The drill string 12 is suspended from a hook 18, attached to a traveling block (also not shown), through the kelly 17 and a rotary swivel 19 which permits rotation of the drill string relative to the hook. A top drive system could alternatively be used.

In the example of this embodiment, the surface system further comprises drilling fluid or mud 26 stored in a pit 27 formed at the well site. A pump 29 delivers the drilling fluid 26 to the interior of the drill string 12 via a port in the swivel 19, causing the drilling fluid to flow downwardly through the drill string 12 as indicated by the directional arrow 8. The drilling fluid exits the drill string 12 via ports in the drill bit 105, and then circulates upwardly through the annulus region between the outside of the drill string and the wall of the borehole, as indicated by the directional arrows 9. In this manner, the drilling fluid lubricates the drill bit 105 and carries formation cuttings up to the surface as it is returned to the pit 27 for recirculation.

The bottom hole assembly 100 of the illustrated embodiment includes a logging-while-drilling (LWD) module 120 and a measuring-while-drilling (MWD) module 130. The bottom hole assembly 100 also may comprise a steerable system 150, and a drill bit 105. In some applications, the bottom hole assembly 100 further comprises a motor which can be used to turn the drill bit 105 or to otherwise assist the drilling operation. Additionally, the steerable system 150 may comprise a rotary steerable system to provide directional drilling.

The LWD module 120 is housed in a special type of drill collar and can contain one or a plurality of known types of logging tools. It will also be understood that more than one LWD and/or MWD module can be employed, e.g., as represented at 120A. (References, throughout, to a module at the position of 120 can alternatively mean a module at the position of 120A as well.) The LWD module may include capabilities for measuring, processing, and storing information, as well as for communicating with the surface equipment. In the present embodiment, the LWD module includes a pressure measuring device.

The MWD module 130 may also be housed in a special type of drill collar and can contain one or more devices for measuring characteristics of the drill string and drill bit. The MWD tool may further include an apparatus (not shown) for generating electrical power to the downhole system. This may include a mud turbine generator (also known as a "mud motor") powered by the flow of the drilling fluid, it being understood that other power and/or battery systems may be employed. In the present embodiment, the MWD module may comprise a variety of measuring devices: e.g., a weight-on-bit measuring device, a torque measuring device, a vibration measuring device, a shock measuring device, a stick slip measuring device, a direction measuring device, and/or an inclination measuring device. As described in greater detail below, the steerable system 150 may also comprise instrumentation to measure desired parameters, such as weight on bit and torque on bit parameters.

The steerable system 150 can be used for straight or directional drilling to, for example, improve access to a variety of subterranean, hydrocarbon bearing reservoirs. Directional drilling is the intentional deviation of the wellbore from the path it would naturally take. In other words, directional drilling is the steering of the drill string so that it travels in a desired direction.

Directional drilling is useful in many offshore drilling applications because it enables many wells to be drilled from a single platform. Directional drilling also enables horizontal drilling through a reservoir. Horizontal drilling enables a longer length of the wellbore to traverse the reservoir, which increases the production rate from the well. A directional drilling system may also be used in vertical drilling operations. Often the drill bit can veer off of a planned drilling trajectory because of the unpredictable nature of the formations being penetrated or because of the varying forces that the drill bit experiences. When such a deviation occurs, a directional drilling system may be used to put the drill bit back on course.

In some directional drilling applications, steerable system 150 includes the use of a rotary steerable system ("RSS"). In an RSS, the drill string is rotated from the surface, and downhole devices cause the drill bit to drill in the desired direction. Rotating the drill string may reduce the occurrences of the drill string getting hung up or stuck during drilling. Rotary steerable drilling systems for drilling deviated boreholes into the earth may be generally classified as either "point-the-bit" systems or "push-the-bit" systems.

In the point-the-bit system, the axis of rotation of the drill bit is deviated from the local axis of the bottom hole assembly in the general direction of the new hole. The hole is propagated in accordance with the customary three-point geometry defined by upper and lower stabilizer touch points and the drill bit. The angle of deviation of the drill bit axis coupled with a finite distance between the drill bit and lower stabilizer results in the non-collinear condition required for a curve to be generated. There are many ways in which this may be achieved including a fixed or adjustable bend at a point in the bottom hole assembly close to the lower stabilizer or a flexure of the drill bit drive shaft distributed between the upper and lower stabilizer. In its idealized form, the drill bit is not required to perform substantial sideways cutting because the bit axis is continually rotated in the direction of the curved hole. Examples of point-the-bit type rotary steerable systems, and how they operate are described in U.S. Patent Application Publication Nos. 2002/0011359; 2001/0052428 and U.S. Pat. Nos. 6,394,193; 6,364,034; 6,244,361; 6,158,529; 6,092,610; and 5,113,953.

In a traditional push-the-bit rotary steerable system there is no specially identified mechanism to deviate the bit axis from the local bottom hole assembly axis; instead, the requisite non-collinear condition is achieved by causing either or both of the upper or lower stabilizers to apply an eccentric force or displacement in a direction that is preferentially orientated with respect to the direction of hole propagation. Again, there are many ways in which this may be achieved, including non-rotating (with respect to the hole) eccentric stabilizers (displacement based approaches) and eccentric actuators that apply force to the drill bit in the desired steering direction. Again, steering is achieved by creating non co-linearity between the drill bit and at least two other touch points and the drill bit cuts sideways to generate a curved hole. Examples of push-the-bit type rotary steerable systems and how they operate are described in U.S. Pat. Nos. 5,265,682; 5,553,678; 5,803,185; 6,089,332; 5,695,015; 5,685,379; 5,706,905; 5,553,679; 5,673,763; 5,520,255; 5,603,385; 5,582,259; 5,778,992; and 5,971,085.

Figure 2:
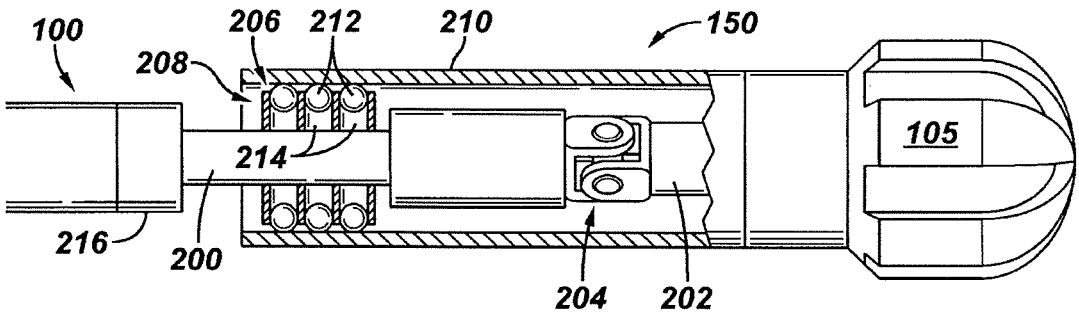
FIG. 2 is a schematic illustration of an example of a steerable system for directional drilling, according to an embodiment of the disclosure.

Referring generally to FIG. 2, a portion of bottom hole assembly 100 is illustrated as comprising steerable system 150 coupled with drill bit 105. In this embodiment, the steerable system 150 comprises a main shaft 200 coupled to an output shaft 202 by a joint 204, such as a universal joint. In a borehole drilling application, the output shaft 202 may comprise a drill bit shaft by which drill bit 105 is rotated during a drilling operation. The output shaft 202, e.g., drill bit shaft, may be pivoted with respect to main shaft 200 about universal joint 204 to enable controlled, directional drilling. An actuation system 206 may be used to maintain the desired angle between output shaft 202 and main shaft 200 during rotation of the drill bit 105 to control drilling direction. In other embodiments, the universal joint 204 may be positioned in other parts of the drill string or tool string. For example, the universal joint 204 and the corresponding actuators can be placed in a controllable flex joint or in other downhole tools, e.g. fishing tools, in which the universal joint 204 and the corresponding actuators serve as an angular actuator in the downhole tool. In some applications, the universal joint 204 may be replaced with other types of flex joints.

In the example illustrated, actuation system 206 comprises a plurality of actuators 208, e.g., ball actuators, which may be individually controlled to maintain the desired pivot angle between output shaft 202 and main shaft 200 about the universal joint 204. As illustrated, each actuator 208 may be coupled between main shaft 200 and a surrounding steering sleeve 210. The steering sleeve 210 is coupled to output shaft 202 such that radial expansion and contraction of actuators 208 causes output shaft 202 to pivot with respect to main shaft 200. However, actuators 208 may be positioned above and/or below universal joint 204. Additionally, the actuators 208 may be designed to act against the steering sleeve 210 or against a surrounding wellbore wall depending on whether the steerable system 150 is generally in the form of a point-the-bit system, a push-the-bit system, or a hybrid system combining point-the-bit features with push-the-bit features, as illustrated. Any of these systems can be used in a rotary steerable system to control pivoting motion of an output shaft with respect to a main shaft about the joint 204. It should be noted the actuating system 206 may be employed in a variety of drilling systems, including coiled tubing drilling systems.

In the embodiment illustrated, the actuators 208 comprise ball actuators located at spaced circumferential positions around the main shaft 200. For example, at least three actuators may be located at circumferential positions but in a variety of applications four actuators may be located at four circumferential positions separated 90° from each other. Each actuator 208 may comprise a single ball 212 or a plurality of balls 212 in which each ball 212 is slidably positioned in a corresponding ball sleeve 214. In the example illustrated in FIG. 2, each actuator 208 is a ball actuator with three balls 212 slidably positioned in three corresponding ball sleeves 214 for selective movement against an interior surface of the steering sleeve 210. Movement of balls 212 of a given actuator 208 against steering sleeve 210 causes steering sleeve 210 and drill bit shaft 202 to pivot with respect to main shaft 200 about universal joint 204. Depending on the application, the ball(s) 212 and the corresponding ball sleeve(s) 214 may be located above or below the universal joint 204. Furthermore, the ball sleeves 214 may be oriented so the balls 212 act against steering sleeve 210 or against shaft 200 or shaft 202 to provide the pivoting motion. In certain mud motor applications, the ball sleeves 214 may be positioned and oriented so the balls 212 act against the shaft of a steerable mud motor.

The selective movement of balls 212 may be controlled by pressurized fluid delivered into the corresponding ball sleeves 214 on an opposite side of the balls 212 relative to steering sleeve 210. Delivery of the pressurized fluid may be controlled by a variety of corresponding flow control systems 216, such as the control systems discussed in the point-the-bit and push-the-bit patents discussed above. By way of example, the flow control system 216 may comprise a rotary valve which selectively controls the flow of pressurized fluid to the actuators 208. In wellbore drilling applications, the flow control system 216 may be a mud valve which controls the flow of actuating drilling fluid to the actuators 208 in a sequential manner. The sequential fluid delivery method energizes actuators 208 as the drill bit 105 rotates to maintain a desired angle between the drill bit shaft 202 and the main shaft 200 so as to maintain a desired drilling direction. The design of actuators 208 and of the overall steerable system 150 provide high dog leg capabilities along with improved resistance to detrimental effects associated with wear, temperature, pressure and mud types. In some embodiments, flow control system 216 may be in the form of a computer-controlled valve able to control the supply of pressurized drilling mud. In this example, computer-controlled system 216 is able to precisely control pivoting about universal joint 204. The precise control can be used for steering, but it also may be used for other purposes, such as angular vibration control.

Figure 3:
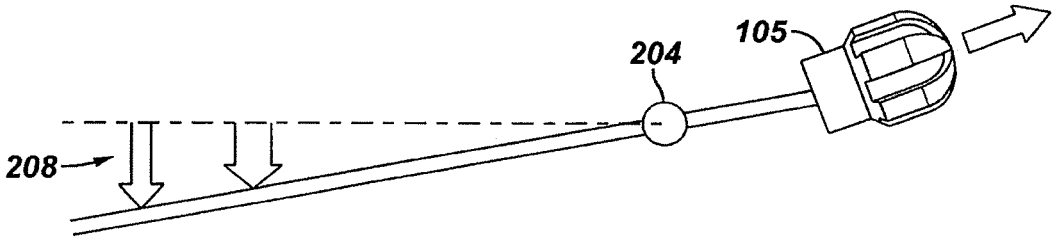
FIG. 3 is a schematic illustration of forces generated by the actuators in a rotary steerable system, according to an embodiment of the disclosure.
Figure 4:
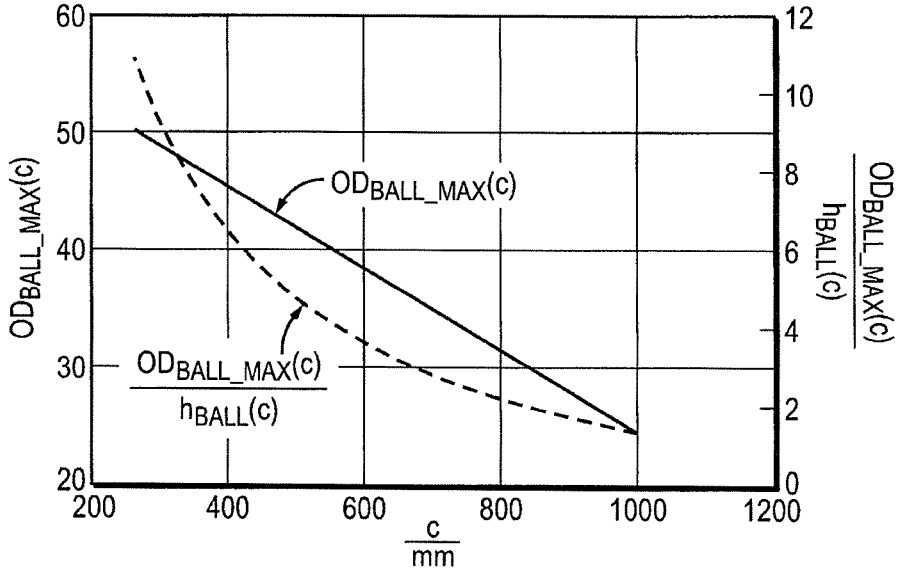
FIG. 4 is a graphical illustration showing ball diameter versus distance from a universal joint of the steerable system, according to an embodiment of the disclosure.

In some embodiments, each actuator 208 comprises a single ball and sleeve and in other embodiments each actuator 208 comprises more than one ball 212 and more than one corresponding ball sleeve 214 to produce a desired force in the limited space between the main shaft 200 and the inside surface of steering sleeve 210. Additionally, the diameter of the balls 212 may be selected to coincide with displacement requirements for desired pointing of the drill bit 105. The selected diameter of the balls 212 also is determined by the distance between the balls 212 and the universal joint 204, as illustrated in the diagram of FIG. 3. Effectively, the displacement of each ball 212 is determined by the position of the ball 212 versus the universal joint 204 and by the inclination angle of the universal joint. The diameter of the balls 212 and the distance between the balls 212 and universal joint 204 are correlated with the desired amount of motion of drill bit shaft 202 with respect to main shaft 200 when pointing the drill bit 105 in a desired drilling direction. In a hybrid push-the-bit and point-the-bit steering system, such as that illustrated in FIG. 2, the ball diameter and ball distance from the universal joint are similarly selected according to the desired steering characteristics of the steerable system 105. In the diagram of FIG. 4, a graphical representation is provided as an example of the maximum ball diameter versus distance away from the universal joint 204. FIG. 4 also illustrates the ratio of maximum ball diameter to desired displacement versus the distance from the universal joint 204 for the same example.

Figure 5:
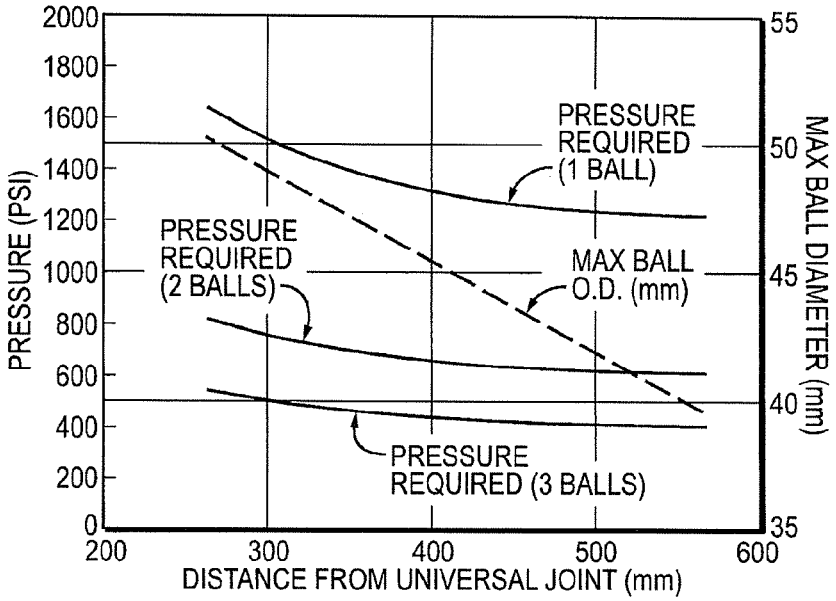
FIG. 5 is a graphical illustration showing pressure requirements of the ball actuators versus distance from a universal joint of the steerable system, according to an embodiment of the disclosure.

When more than one ball 212 is used in each ball actuator 208, the pressure drop between the inside of the steerable system 150 and the annulus of the wellbore around the steerable system 150 can be reduced while maintaining the same force acting on the steering sleeve 210. By using a set of smaller balls 212, a larger combined surface area can be created to enable use of a lower pressure drop while producing the same amount of force as compared to a single larger ball with a smaller surface area. The single larger ball 212 would require a larger pressure drop to create the desired force against steering sleeve 210. In FIG. 5, a graphical representation is provided to illustrate the pressure associated with different numbers of balls 212 in individual actuators 208. Generally, the pressure drop required is reduced when additional balls 212 are used in each actuator 208. FIG. 5 illustrates an example of the pressure acting against the ball or balls 212 versus distance from the universal joint 204 so as to provide sufficient force to steer the drill bit. The Figure also illustrates a desired ball diameter at a given distance from the universal joint 204.

When the supply of pressurized fluid used to actuate balls 212 in a given actuator 208 is broken, the pressurized fluid can escape from the ball sleeves 214 either through gaps between the balls and the sleeve or through exhaust grooves or ports in the sleeve or the balls. For example, the pressurized fluid, e.g., drilling mud, can escape through a suitable exhaust port outside the assembly of ball(s) 212 and ball sleeve(s) 214. As the pressurized fluid escapes, the pressure acting against the ball or balls 212 is reduced and the balls can move in an opposite direction along the corresponding ball sleeves 214. In other words, the balls 212 of that particular actuator 208 no longer act against an interior surface of the steering sleeve 210. The sequential delivery of pressurized fluid and the breaking or interruption of that pressurized fluid to the plurality of circumferentially spaced actuators 208 allows the steerable system 150 to maintain its steering direction.

Figure 6:
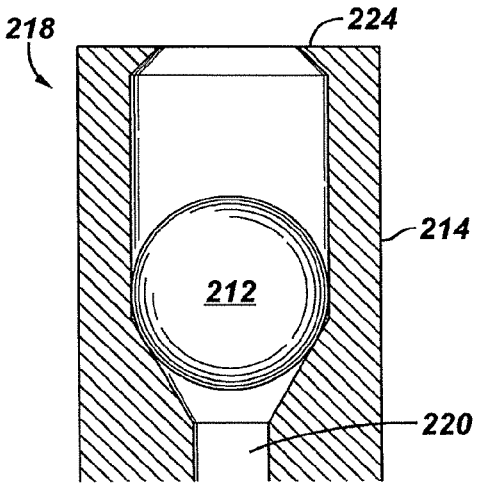
FIG. 6 is a schematic cross-sectional view of a ball actuator having a ball piston located in a ball sleeve, according to an embodiment of the disclosure.
Figure 7:
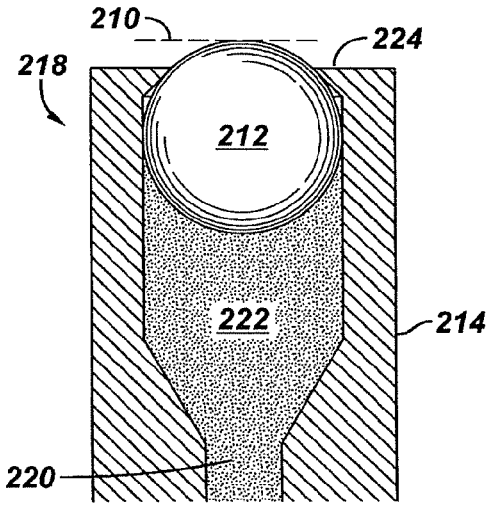
FIG. 7 is a schematic cross-sectional view of the ball actuator illustrated in FIG. 6 but showing the ball piston in an actuated position, according to an embodiment of the disclosure.
Figure 8:
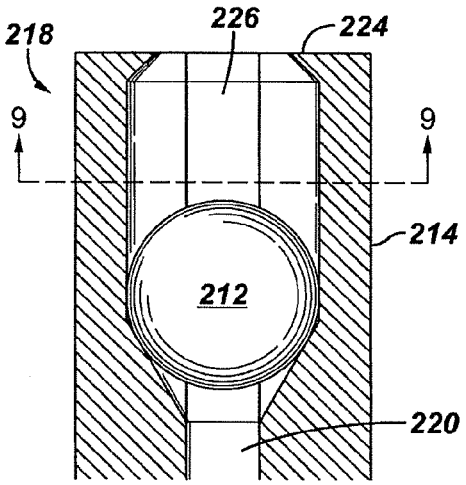
FIG. 8 is a schematic cross-sectional view of the ball actuator in which the sleeve comprises a groove for allowing actuating fluid and particles to escape, according to an embodiment of the disclosure.

Referring generally to FIGS. 6-9, an example of ball 212 located in its corresponding sleeve 214 is illustrated. In this example, FIG. 6 illustrates a cross-sectional view of an example of a ball piston steering device 218 which may be used individually or in combination with additional ball steering devices 218 in each of the actuators 208. The ball piston steering device 218 comprises ball 212 provided within its corresponding sleeve 214. In this example, the sleeve 214 includes an orifice 220 for communication with a fluid source, such as the source of pressurized drilling fluid supplied by pump 29. As illustrated in FIG. 7, a fluid 222, e.g., drilling mud, enters orifice 220 to push ball 212 to an extended position in which the ball moves steering sleeve 210 by creating a force against the interior surface of sleeve 210. A lip 224 may be used to retain the ball 212 within the ball sleeve 214.

Figure 9:
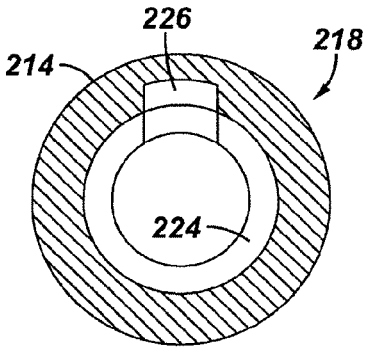
FIG. 9 is a schematic cross-sectional view of the ball actuator taken generally along line 9-9 of FIG. 8, according to an embodiment of the disclosure.
Figure 10:
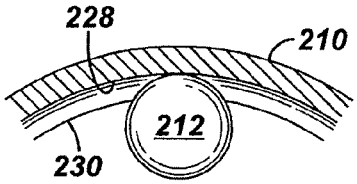
FIG. 10 is a schematic illustration of a ball piston positioned against an interior surface of a steering sleeve within a groove to reduce contact pressure, according to an embodiment of the disclosure.

Referring generally to FIGS. 9 and 10, an example of the ball piston steering device 218 is provided in which the sleeve 214 includes a groove 226 to allow the fluid to escape from the sleeve 214, as described above. The groove 226 also may be used to provide lubrication for the ball 212 and for other portions of bottom hole assembly 100. Additionally, the groove 226 may provide a fluid pathway which facilitates removal of debris, e.g., particles, in the interface region of the ball 212 and ball seat 214.

In some embodiments, ball 212 may be coated or it may be comprised of a wear-resistant material such a metal, a resin, or a polymer. For example, the ball 212 may be fabricated from steel, "high speed steel", carbon steel, brass, copper, iron, polycrystalline diamond compact (PDC), hardface, ceramics, carbides, ceramic carbides, cermets, or other suitable materials. It should be noted that drilling mud or other fluid bypassing around the ball 212 along groove 226 during actuation and while escaping after actuation can move at high velocity. In some applications, the high velocity fluid is directed into the wellbore through, for example, flow outlets in the steering sleeve 210. Directing the high velocity fluid into the wellbore reduces the potential for damage to the steerable system 150, such as damage resulting from erosion to an internal diameter of the steering sleeve 210.

Contact between balls 212 and the interior surface of steering sleeve 210 can create high contact forces/pressures in some applications. However, a variety of techniques may be used to reduce stresses at the contact point by increasing footprint area. For example, a ball groove 228 or grooves may be machined or otherwise formed in an interior surface 230 of steering sleeve 210, as illustrated in FIG. 10. The use of multiple balls 212 in each actuator 208 also can be employed to mitigate the contact stresses between the ball(s) 212 and the steering sleeve 210. In some applications, multiple ball grooves 228 may be used with multiple corresponding balls 212 to further reduce contact stresses and to thus allow for a lower pressure drop between the pressure of the fluid actuating balls 212 and the pressure in the surrounding wellbore.

Figure 11:
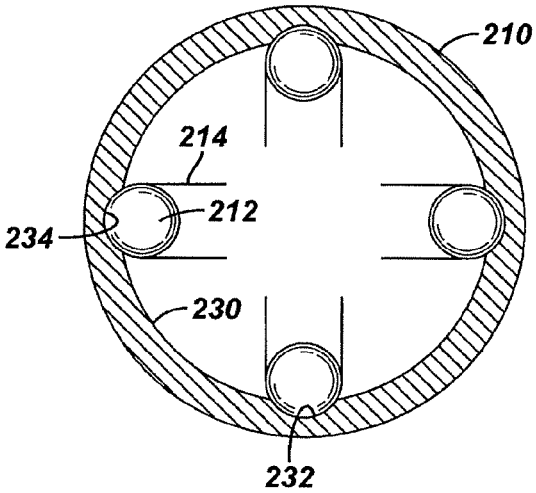
FIG. 11 is a schematic illustration of a steering sleeve having a plurality of profiled recesses for receiving ball pistons of the ball actuators, according to an embodiment of the disclosure.

Additional approaches may be used alone or in combination to limit contact stresses and/or to facilitate control over the movement of steering sleeve 210 and thus over the direction of drilling. As illustrated in the example of FIG. 11, the steering sleeve 210 may be designed with a contact profile 232 along interior surface 230 to improve tool face control of the steering sleeve 210. For example, the contact profile 232 may comprise recesses 234 having a deeper curvature than the normal inside diameter of the steering sleeve 210.

In some embodiments, the balls 212 can have shapes other than spherical shapes to transmit the work done by the actuating fluid 222 when creating mechanical force able to drive balls 212 against steering sleeve 210. As used herein, the terms ball or balls 212 are not limited to balls being spherical in shape but instead include a broader range of shapes and may comprise members with a variety of curvatures. For example, the balls 212 may have cylindrical or obround shapes designed to limit the contact stress with or without a uniquely designed contact profile 232. In some applications, the surface shape of the balls 212 can be changed instead of changing the interior surface 230 of steering sleeve 210. Other approaches may comprise forming balls 212 with different diameters with respect to each other or increasing the number of actuators 208 and/or increasing the number of balls 212 in each actuator 208. The balls 212 may have a profiled shape which corresponds to a profiled shape of the interior surface of the steering sleeve 210 to improve the stability of the well tool, e.g. steerable system 150. In some examples, each ball 212 may be received in a corresponding well or recess of the steering sleeve 210 to improve stability.

Additionally, the balls 212 can be activated according to a variety of programs or techniques. For example, the balls 212 in a given actuator or actuators 208 may all be energized/actuated at once; zero balls 212 may be actuated; or various combinations of balls 212 may be actuated depending on the type of mud valve 216 (or other flow control system) used to control flow of actuating fluid 222 to actuators 208. In a row of balls 212 for a given actuator 208, for example, a subset of the total number of balls 212 can be actuated to reduce the steering force during certain steering operations. By way of further example, an embodiment may be designed to actuate a single ball 212 or two balls 212 of a three ball actuator 208 while the other balls 212 remain un-actuated.

Figure 12:
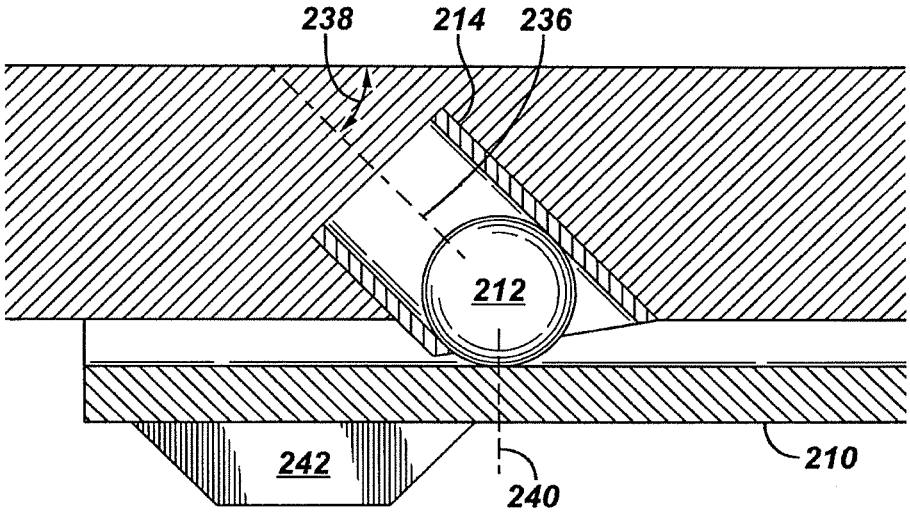
FIG. 12 is a schematic illustration showing a ball sleeve of a ball actuator oriented at a non-perpendicular angle with respect to the steering sleeve, according to an embodiment of the disclosure.

In another example, a central axis 236 of each corresponding ball sleeve 214 may be positioned at a non-perpendicular angle 238 with respect to a radial line 240 intersecting sleeve 210, as illustrated in FIG. 12. By delivering the ball 212 against sleeve 210 at angle 238, the actuating force can be increased while the effective stroke moving sleeve 210 is reduced. As further illustrated in FIG. 12, some embodiments of steering sleeve 210 may incorporate stabilizers 242 designed to act against a surrounding wellbore wall.

Figure 13:
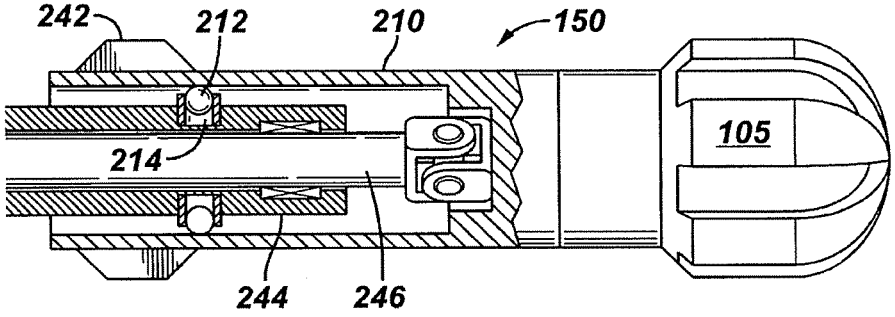
FIG. 13 is a schematic cross-sectional view of a rotary steerable system in which the ball pistons have rolling contact with a steering sleeve, according to an embodiment of the disclosure.

Depending on the parameters of a given drilling application, the balls 212 also may be used as a "rotating" contact in an integrated rotary steerable system and motor system, as illustrated in FIG. 13. In these types of applications, the steering sleeve 210 is rotated but a motor stator/body 244 which remains stationary relative to the rotating steering sleeve 210. A motor drive shaft 246 is directly coupled to steering sleeve 210 and drill bit 105 to provide rotation. In this type of application, the balls 212 are used to both push against the interior surface of the steering sleeve 210 so as to steer the drill bit 105 while also facilitating rotational movement of the steering sleeve 210 when rotating the drill bit 105 via drive shaft 246.

Figure 14:
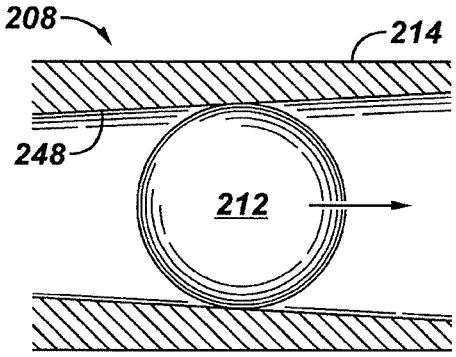
FIG. 14 is a schematic illustration showing a ball piston located in a ball sleeve having a varying cross-sectional area, according to an embodiment of the disclosure.
Figure 15:
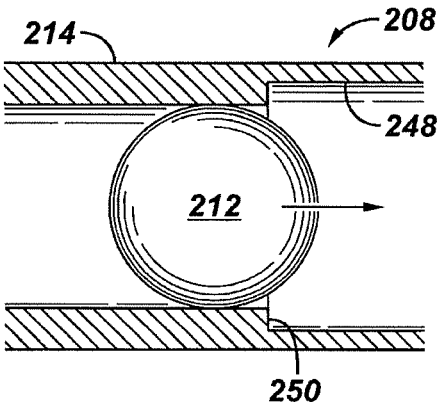
FIG. 15 is a schematic illustration showing a ball piston located in another type of ball sleeve having a varying cross-sectional area, according to an embodiment of the disclosure.

Referring generally to FIGS. 14 and 15, another embodiment is illustrated in which the ball sleeve 214 changes in cross-sectional area along its length to vary the clearance between the ball 212 and the inside surface of the ball sleeve 214. By way of example, this approach can be used alone or in combination with groove 226. As illustrated in FIG. 14, an inside surface 248 of the ball sleeve 214 can be tapered to create a tapered ball sleeve in which clearance varies as the stroke of the ball 212 changes. For example, the taper and thus the cross-sectional area can change to provide a tighter gap when the ball 212 is exerting maximum force while allowing a larger clearance gap at full stroke to limit the force and to clean the interior of the ball sleeve 214. FIG. 15 illustrates another embodiment in which the cross-sectional area changes along the length of the ball sleeve, but the change is achieved by using a step or a plurality of steps 250 along the interior of the ball sleeve 214.

In some embodiments, the load distribution and the force direction can be adjusted by arranging the axes 236 of the ball sleeves 214 in different orientations. For example, the axes of the ball sleeves 214 containing a line of balls 212 along one side of steerable system 150 may be different than the orientation of the axes of the ball sleeves 214 along a different side of the steerable system 150. The balls 212 and the corresponding ball sleeves 214 also may be arranged along a spiral line on each side of the steerable system 150. For example, each actuator 208 may have a plurality of balls 212 and corresponding ball sleeves 214 that are arranged generally along a spiral line. As discussed above, the ball sleeves may each have single or plural slots or grooves 226 to control the leakage of actuating fluid, e.g., drilling mud, with or without increasing clearance.

Figure 16:
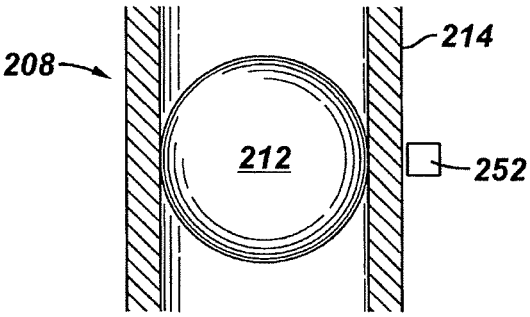
FIG. 16 is a schematic illustration showing instrumentation combined with a ball actuator of the steerable system, according to an embodiment of the disclosure.

Referring generally to FIG. 16, another example is illustrated in which at least some of the actuators 208 are instrumented. A sensor or a plurality of sensors 252 may be located to monitor the position of ball 212 in its corresponding ball sleeve 214. By way of example, sensors 252 may be positioned along each ball sleeve 214 to monitor the position of the ball 212 within the ball sleeve 214. Monitoring the positions of the balls 212 can enable determination of the tilt angle of steering sleeve 210 to help monitor drilling direction. A variety of sensors 252 may be used depending on the parameters of a given application. Examples of sensors 252 include inductive sensors, magnetic sensors, acoustic sensors, and other suitable sensors.

Figure 17:
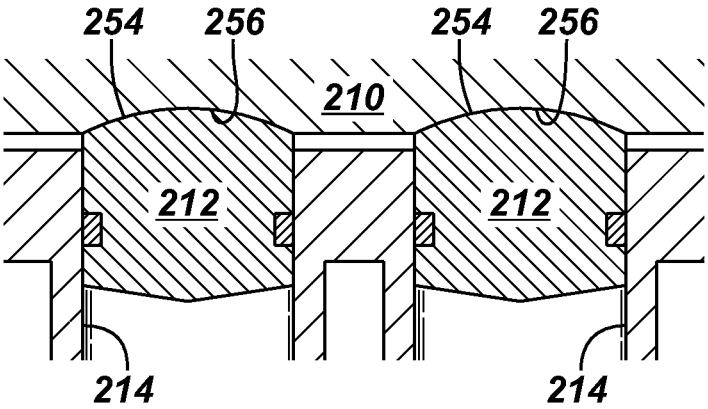
FIG. 17 is a schematic illustration of balls having a non-spherical, profiled shape which increases the footprint for the same diameter while decreasing the contact stress, according to an embodiment of the disclosure.

Referring generally to FIG. 17, another embodiment is illustrated in which the balls 212 are in a non-spherical form. For example, the balls 212 may be cylindrical in shape or barrel shaped with a profiled surface 254 designed to act against a corresponding profiled surface 256 of the steering sleeve 210 or of another actuatable member. The profiled surface 254 and the corresponding profiled surface 256 may be shaped to provide certain functionality. For example, the profiled surfaces may be designed to increase the footprint while maintaining the same general diameter of the ball 212 so as to reduce contact stress.

Figure 18:
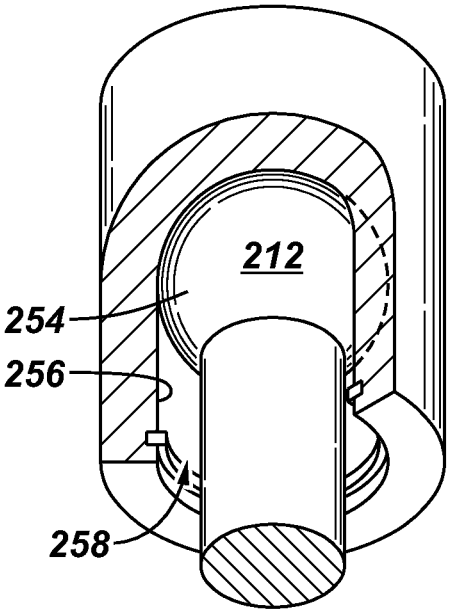
FIG. 18 is a schematic illustration of a ball received in a corresponding recess, according to an embodiment of the disclosure.

Another example is illustrated in FIG. 18 in which the ball 212 also comprises profiled surface 254. In this example, the ball 212 may be spherical in shape or have another suitable shape to present the desired profiled surface 254. The corresponding profiled surface 256 is formed in a well or recess 258 which contains the ball 212. In some examples, the well or recess 258 may be designed to securely retain the profiled surface 254 during operation of the downhole tool.

Depending on the drilling application, the bottom hole assembly and the overall drilling system may comprise a variety of components and arrangements of components. Additionally, the actuation system may comprise many different types of actuator arrangements depending on the specific parameters of a given drilling operation. The actuation system may be coupled with a variety of control systems, such as processor-based control systems which are able to evaluate sensor data and output information. In some embodiments, the control system may be programmed to automatically adjust the drilling direction based on programmed instructions. Additionally, a variety of rotary steerable systems and other steerable systems may be used to facilitate the directional drilling. Also, universal joints and other types of joints may be used to provide the flexure point between the main shaft and the output shaft.

Although a few embodiments of the system and methodology have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A system, comprising:

a directional steerable system having a main shaft coupled to a second shaft by a pivot point, the second shaft being coupled to a steering sleeve, and a plurality of actuators mounted at each circumferential positions of a plurality of different circumferential positions for engagement with the steering device to selectively pivot the steering sleeve and the second shaft with respect to the main shaft, each actuator comprising a loose element slidably mounted in a piston sleeve oriented to allow the loose element to act against the steering sleeve when sufficient pressure is applied to the loose element within the piston sleeve, a subset of the plurality of actuators mounted at a given circumferential position being actuatable while others of the plurality of actuators mounted at the given circumferential position remain un-actuated.

2. The system as recited in claim 1, wherein each actuator comprises a plurality of balls slidably each mounted in a corresponding piston sleeve.

3. The system as recited in claim 2, wherein the plurality of actuators comprises at least three actuators circumferentially spaced around the main shaft and within the steering sleeve.

4. The system as recited in claim 3, further comprising a valve located to control flow of pressurized drilling mud to the plurality of actuators.

5. The system as recited in claim 3, wherein the loose elements are substantially spherical balls and the plurality of substantially spherical balls provides rolling contact with an internal surface of the steering sleeve.

6. The system as recited in claim 2, wherein certain balls of the plurality of balls have different diameters with respect to each other.

7. The system as recited in claim 1, wherein the steering sleeve comprises at least one surface profiled to receive the loose element in a manner that reduces contact stress during pivoting of the steering sleeve.

8. The system as recited in claim 1, wherein the piston sleeve is oriented at a non-perpendicular angle with respect to the steering sleeve.

9. The system as recited in claim 1, wherein the piston sleeve changes in cross-sectional area along its length to vary clearance between the loose element and the piston sleeve.

10. The system as recited in claim 1, further comprising a sensor positioned to monitor a position of the loose element in the piston sleeve.

11. A method for drilling a borehole, comprising:

preparing a directional drilling system with a main shaft pivotably coupled to a second shaft by a pivot point;

coupling a plurality of actuators into the directional drilling system with each actuator comprising a ball slidably mounted in a sleeve;

orienting each sleeve such that controlled movement of the ball along the sleeve causes the second shaft to pivot about the pivot joint with respect to the main shaft;

positioning a sensor along each sleeve to directly monitor a position of the ball along the sleeve;

connecting a steering sleeve to the second shaft, wherein coupling comprises mounting the plurality of actuators between the main shaft and the steering sleeve at spaced circumferential positions around the main shaft; and forming at least one recess along an internal surface of the steering sleeve to receive at least one ball in a manner that reduces contact stress.

12. The method as recited in claim 11, further comprising forming each actuator with a plurality of balls slidably positioned in a plurality of corresponding sleeves.

13. The method as recited in claim 12, further comprising controlling movement of the ball against an interior surface of the steering sleeve by selectively applying pressurized drilling mud to each actuator in a sequential manner to maintain a desired angle of drilling during rotation of the drill bit shaft.

14. The method as recited in claim 13, further comprising coupling a drill bit to the second shaft and rotating the drill bit to drill a wellbore.

15. The method as recited in claim 11, wherein coupling comprises positioning the plurality of actuators above the pivot joint.

16. The method as recited in claim 11, wherein coupling comprises positioning the plurality of actuators below the pivot joint.

17. The method as recited in claim 11, wherein orienting comprises orienting each sleeve such that movement of each ball along a corresponding sleeve enables each ball to act against at least one of the main shaft and the second shaft.

18. The method as recited in claim 11, further comprising moving each ball with a pressurized drilling mud and controlling the flow of drilling mud with a computer-controlled valve of a flow control system.

19. The method as recited in claim 11, further comprising providing each ball with a shape that corresponds with a profile along an interior of the steering sleeve.

20. A method of drilling a wellbore, comprising:

coupling a directional drilling system to a drill string, wherein the directional drilling system comprises a main shaft pivotally coupled to a drill bit shaft;

steering the rotary steerable system by selectively directing drilling mud to a plurality of ball actuators positioned within a steering sleeve coupled to the drill bit shaft of the directional drilling system; each ball actuator comprising a ball moved within a corresponding ball sleeve by an actuating fluid to enable the ball to apply a force;

operating the directional drilling system to drill a deviated wellbore; and changing the force which can be applied by the ball as the ball travels along the ball sleeve.

21. The method as recited in claim 20, wherein steering comprises using a mud valve to selectively direct drilling mud under pressure to selected ball actuators and against a plurality of balls such that movement of the balls causing pivoting of the steering sleeve and the drill bit shaft to a desired drilling direction.

22. The method as recited in claim 20, further comprising pivotably coupling the drill bit shaft to the main shaft via a universal joint.

* * * * *